United States Patent [19]

Driessen et al.

[11] 3,999,305

[45] Dec. 28, 1976

[54] HAIR-DRYING HOOD

[75] Inventors: Henricus Josef Driessen; Andreas Fredericus Rietveld, both of Drachten, Netherlands

[73] Assignee: U.S. Philips Corporation, New York, N.Y.

[22] Filed: Feb. 27, 1975

[21] Appl. No.: 553,533

[30] Foreign Application Priority Data

Mar. 5, 1974 Netherlands ..... 7402922

[52] U.S. Cl. ..... 34/99

[51] Int. Cl.[2] ..... A45D 20/24

[58] Field of Search ..... 34/96–101, 34/3; 219/368–371

[56] References Cited

UNITED STATES PATENTS

| | | | |
|---|---|---|---|
| 1,840,929 | 1/1932 | Bair | 34/99 |
| 1,998,198 | 4/1935 | Leland | 34/99 |
| 2,003,610 | 6/1935 | Santurello | 34/99 |
| 2,023,883 | 10/1935 | Gross | 34/99 |
| 3,840,723 | 10/1974 | Ohnmacht et al. | 34/99 |

FOREIGN PATENTS OR APPLICATIONS

| | | | |
|---|---|---|---|
| 195,051 | 5/1957 | Germany | 34/99 |

*Primary Examiner*—Kenneth W. Sprague
*Assistant Examiner*—James C. Yeung
*Attorney, Agent, or Firm*—Frank R. Trifari

[57] ABSTRACT

A hair-drying hood with a fan, an electric motor, and a heating element and a partition with means for varying the air flow and the amount of heat input to said air in different circumferential locations.

5 Claims, 3 Drawing Figures

HAIR-DRYING HOOD

BACKGROUND OF THE INVENTION

The invention relates to a hair-drying hood comprising a fan which is driven by an electric motor and a heating element for producing a stream of heated air to a drying space in the hood. Parameters relating to said air stream such as the air temperature and the air displacement, per unit of time are variable separately or jointly.

A hair-drying hood of said type is for example known from Netherlands Pat. Application 72 115 29. Owing to individual differences in hair and style it is not always possible to dry the hair uniformly with such a hair-drying hood. This has the disadvantage that the drying process takes more time than necessary, while the supply of warm air to those parts of the hair which have already dried is often experienced as unpleasant.

SUMMARY OF THE INVENTION

It is an object of the invention to mitigate said drawbacks and to provide a hair-drying hood of the above-mentioned type, which is characterized in that the hood is provided with means of influencing the previously mentioned parameters locally in the drying space. This allows for example the temperature of the stream of air or the amount of air flowing in per unit of time to be increased at those locations in the drying space of the hairdrying hood where this is necessary, so that the hair will be dry all over the head at substantially the same time.

In a special embodiment the drying space of the hair-drying hood is separated from the compartment which accomodates the fan and the heating element by a partition; the partition comprises flow passages which can at least partly be closed by means of a closing member which can be actuated externally, the closing member may then be annular and rotatable between different positions an, alternative embodiment is characterized in that the heating element comprises separately switchable sections.

A preferred embodiment thereof is characterized in that the hood is provided both with a first annular undivided element and a second annular element concentric therewith with separately switchable sections.

The invention will be described hereinafter with reference to embodiments shown in the drawing.

DETAILED DESCRIPTION OF THE PREFERRED EMBODIMENT

Figure 1:
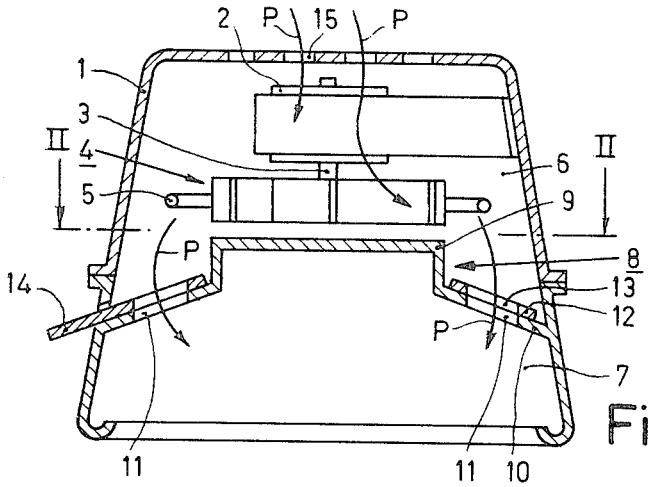
FIG. 1 is an elevation in section of a hair-drying hood of the invention.
Figure 2:
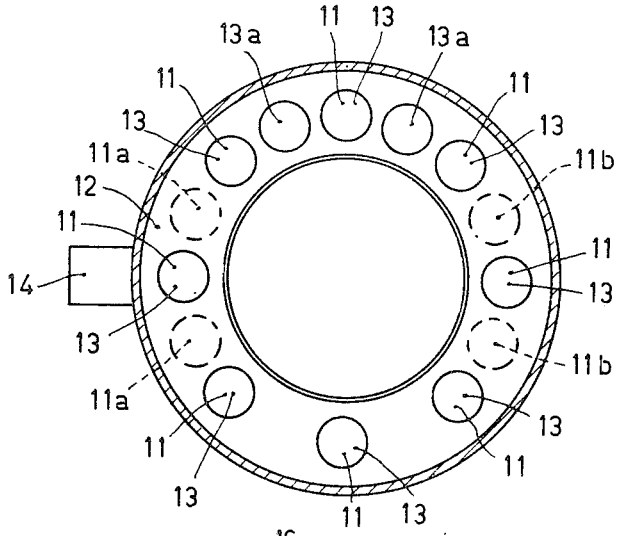
FIG. 2 is a cross-sectional view taken along line II-II in FIG. 1.

FIGS. 1 and 2 show a simple embodiment in which by mechanical means the supply of warm air can be varied locally in the drying space, the hair-drying hood 1 comprises an electric motor 2 with a fan 4 mounted on the shaft 3. Around the fan an annular heating element 5 is disposed. The compartment 6 which accomodates the motor, the fan and the heating element is separated from the drying space 7 by a partition 8. Said partition comprises a central part 9 adjoined by an annular part 10 which is provided with openings 11.

The annular part 10 comprises a similar annular closing member 12 with openings 13 which correspond to the openings 11. The annular closing member 12 is rotably journalled around the central part 9 and can be actuated externally by means of the handle 14. The air which is drawn in by the fan 4 via the inlet openings 15 then flows past and is heated by the heating element 5. Subsequently, the heated air can pass through partition 8 and enter the drying space 7 at those locations where an opening 13 is adjacent an opening 11. The air flow inside the hood will substantially be as indicated by the arrows P.

In the situation of FIG. 2 the locations where an opening in the closing member 12 is disposed over an opening in the partition 8 are designated both 11 and 13. However, some openings in the partition 8 are covered by the closing member 12, as are designated 11*a* at the front of the hood and 11*b* at the rear of the hood. When the closing member is rotated a quarter turn clockwise or anti-clockwise with the aid of the handle 14, the spare openings 13*a* in the closing member 12 will be positioned over the openings 11*a* or 11*b*. Thus, it is possible to supply more warm air to those parts of the hair-dress which do not readily dry, for example the front or rear of the head, than to other parts thereof so that the hair-dress can be dried uniformly.

Obviously, it is also possible to design the hood in such a way that at other locations in the drying space, additional power in the form of heat per unit of time is supplied. For this purpose the partition 8 may for example be provided with a multiplicity of individually controllable closing members by means of which the passages in the partition can be opened or closed completely or partly at different locations and independently of each other. Furthermore, the central part 9 in the embodiment of FIGS. 1 and 2 may be provided with passages with an associated closing member. Said member may or may not be coupled to the annular closing member 12.

Figure 3:
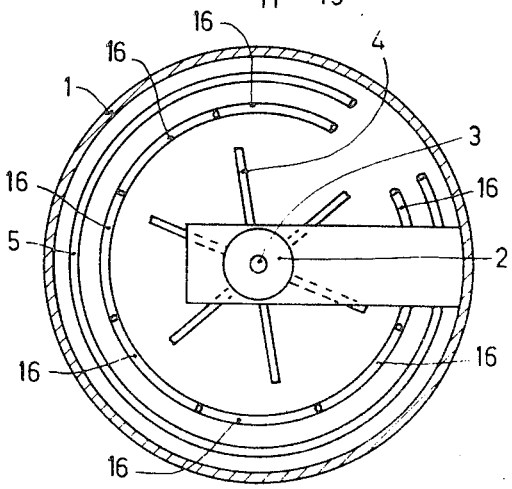
FIG. 3 is a cross-sectional view similar to FIG. 2 of a different embodiment.

In the embodiment of FIG. 3 a second heating element which consists of sections 16 is added to the heating element 5. Each section 16 is provided with separate connections and can be switched on or off separately. Thus, the temperature of the air which flows into the drying space can be influenced locally so as to ensure uniform drying of entire hair-dress. Instead of two parallel-connected annular elements it also suffices to use a single annular element which is divided into separately switchable sections.

What is claimed is:

1. A hair drying hood operable with a source of electric current and comprising a housing with a partition therein defining on opposite sides of the partition a heating area and a drying area, an electric motor and attached air blower mounted in said heating area portion of the housing for providing an air flow, and heating means mounted in said heating area for heating said air flow, said partition including a plurality of air flow apertures spaced circumferentially for communicating said heating area with said drying areas through the partition, and movable closing means for constricting selected ones of said apertures for varying the quantity and location circumferentially of said heated air flow into said drying area, said heating means being a first annular heating member comprising circumferentially spaced heating elements, and means for energizing selected ones of said elements for varying the heated portion of the air flow.

2. Apparatus according to claim 1 wherein said heating means further comprises a second heating member comprising a single annular heating element, adjacent said first heating element.

3. A hair drying hood operable with a source of electric current and comprising a housing with a partition therein defining on opposite sides of the partition a heating area and a drying area, an electric motor and attached air blower mounted in said heating area portion of the housing for providing an air flow, and heating means mounted in said heating area for heating said air flow, said partition including a plurality of air flow apertures spaced circumferentially for communicating said heating area with said drying areas through the partition, and movable closing means for constricting selected ones of said apertures for varying the quantity and location circumferentially of said heated air flow into said drying area.

4. Apparatus according to claim 3 wherein said closing means is an annular member impervious to said air flow with a plurality of circumferentially spaced second apertures therethrough, said member being rotatably movable for selectively aligning said second apertures with said partition apertures.

5. Apparatus according to claim 3 further comprising lever means attached to said closing means and extending externally of said housing for moving said closing means to vary said air flow.

* * * * *